US008720703B1

(12) United States Patent
Pressler et al.

(10) Patent No.: US 8,720,703 B1
(45) Date of Patent: May 13, 2014

(54) APPARATUS FOR HOLDING AND DRYING BRUSHES

(71) Applicants: Denise Kathleen Pressler, Bethel Island, CA (US); Kurt Terry Pressler, Bethel Island, CA (US)

(72) Inventors: Denise Kathleen Pressler, Bethel Island, CA (US); Kurt Terry Pressler, Bethel Island, CA (US)

( * ) Notice: Subject to any disclaimer, the term of this patent is extended or adjusted under 35 U.S.C. 154(b) by 29 days.

(21) Appl. No.: 13/671,818

(22) Filed: Nov. 8, 2012

(51) Int. Cl.

| | |
|---|---|
| ***A47B 81/02*** | (2006.01) |
| ***A47B 53/00*** | (2006.01) |
| ***A47F 5/025*** | (2006.01) |
| ***B44D 3/12*** | (2006.01) |
| ***A47K 1/09*** | (2006.01) |
| ***A47F 7/00*** | (2006.01) |
| ***A47B 17/06*** | (2006.01) |
| *A47L 13/51* | (2006.01) |

(52) U.S. Cl.

CPC ..... *B44D 3/125* (2013.01); *B44D 3/123* (2013.01); *A47K 1/09* (2013.01); *A47L 13/51* (2013.01); *A47F 7/0028* (2013.01); *A47B 81/02* (2013.01); *A47B 17/06* (2013.01)

USPC ..... 211/65; 211/1.3; 211/2

(58) Field of Classification Search

CPC ..... A47K 1/09; A47K 11/10; A47K 5/18; B44D 3/006; B44D 3/12; B44D 3/123; B44D 3/00; B44D 3/125; A47L 13/512; A47L 13/51; A47L 13/50; A46B 17/06; A46B 17/00; A46B 17/02; A47F 7/0028; A47F 7/0021; B25H 3/04; A47B 81/005; A47B 81/02; A47G 25/12; A47J 47/18; A47J 47/20; A45D 44/18

USPC ..... 211/65, 66, 60.1, 70.6, 1.3, 69.1, 69.5, 211/2, 69.8, 69.9, 196; 248/110, 111, 112, 248/113; 220/736, 570; 206/209, 209.1, 206/361, 362, 362.1, 362.2, 362.3, 15.2, 206/15.3, 362.4; 312/207, 206; 34/107, 34/109, 113, 127, 239

See application file for complete search history.

(56) References Cited

U.S. PATENT DOCUMENTS

| | | | | | |
|---|---|---|---|---|---|
| 599,744 | A | * | 3/1898 | Steinmeyer | 211/66 |
| 670,481 | A | * | 3/1901 | Kirkwood | 211/65 |
| 1,005,985 | A | * | 10/1911 | Lebherz | 211/65 |
| 1,223,043 | A | * | 4/1917 | Draper | 211/66 |
| 1,566,860 | A | | 12/1925 | Hainzigianis | |
| 1,690,311 | A | * | 11/1928 | Reich | 206/362.3 |
| 1,892,500 | A | * | 12/1932 | Bleckley | 211/70.7 |
| 2,121,488 | A | | 6/1938 | Nofz | |
| 2,145,456 | A | * | 1/1939 | Oshman et al. | 211/65 |
| 2,177,504 | A | * | 10/1939 | Thompson | 206/361 |
| 2,415,447 | A | * | 2/1947 | Stanton | 132/310 |
| 3,327,688 | A | * | 6/1967 | Smith | 206/214 |
| 3,365,761 | A | | 1/1968 | Kalvig | |
| 3,605,160 | A | * | 9/1971 | Maurer | 15/105 |
| 3,881,868 | A | * | 5/1975 | Duke | 206/209.1 |
| 3,990,755 | A | * | 11/1976 | Krause | 312/207 |
| 4,214,657 | A | * | 7/1980 | Winston | 206/209.1 |
| 4,305,511 | A | | 12/1981 | Denholtz | |
| 4,538,736 | A | * | 9/1985 | Berger | 211/69.5 |
| 4,615,456 | A | * | 10/1986 | Cousar | 220/697 |
| 4,627,125 | A | * | 12/1986 | Gruns | 15/105 |
| D304,512 | S | * | 11/1989 | Byers et al. | D32/35 |

(Continued)

*Primary Examiner* — Jennifer E Novosad
(74) *Attorney, Agent, or Firm* — Thomas R. Lampe

(57) ABSTRACT

Apparatus for holding and drying brushes includes two brush holder components alternatively connectable to form a first configuration wherein brushes are held with the applicator portions thereof above the handles and a second configuration wherein the applicator portions are below the handles.

9 Claims, 2 Drawing Sheets

(56) References Cited

U.S. PATENT DOCUMENTS

| | | | | | |
|---|---|---|---|---|---|
| 4,884,701 | A | | 12/1989 | Nymark et al. | |
| 4,905,951 | A | * | 3/1990 | Putness | 248/316.1 |
| 5,082,119 | A | * | 1/1992 | Bingley | 211/4 |
| 5,097,967 | A | * | 3/1992 | Sica | 211/66 |
| 5,222,610 | A | * | 6/1993 | Johansen et al. | 211/69.5 |
| 5,242,063 | A | * | 9/1993 | Ericksen et al. | 211/65 |
| D354,989 | S | | 1/1995 | West | |
| 5,799,910 | A | * | 9/1998 | Dexter | 248/109 |
| 5,842,566 | A | * | 12/1998 | White | 206/362 |
| 5,992,912 | A | * | 11/1999 | Zimm | 294/143 |
| 6,022,159 | A | * | 2/2000 | Kossnar et al. | 401/35 |
| 6,402,104 | B1 | * | 6/2002 | Smith | 248/205.5 |
| 6,457,592 | B1 | * | 10/2002 | Rozen | 211/65 |
| 7,090,072 | B1 | * | 8/2006 | Elliott | 206/15.3 |
| 7,234,602 | B2 | | 6/2007 | Roberti | |
| 7,246,709 | B2 | * | 7/2007 | Kim | 211/65 |
| 7,984,813 | B1 | * | 7/2011 | Tapager | 211/74 |
| 8,567,617 | B1 | * | 10/2013 | Tapager | 211/74 |
| 2002/0104771 | A1 | * | 8/2002 | Young et al. | 206/371 |
| 2003/0070998 | A1 | * | 4/2003 | Bulka | 211/66 |
| 2004/0159752 | A1 | * | 8/2004 | Vukas | 248/110 |
| 2006/0180559 | A1 | * | 8/2006 | Roberti | 211/65 |
| 2006/0243685 | A1 | * | 11/2006 | Monroig | 211/65 |
| 2007/0235395 | A1 | | 10/2007 | Mondale et al. | |
| 2011/0108501 | A1 | | 5/2011 | Ambrosen | |

* cited by examiner

APPARATUS FOR HOLDING AND DRYING BRUSHES

TECHNICAL FIELD

This invention relates to apparatus for holding and drying brushes having a handle and an applicator portion in the form of bristles or other material connected to the handle. The invention is applicable, for example, for holding and drying brushes employed to apply cosmetics. However, the invention is suitable for use with other types of brushes.

BACKGROUND OF THE INVENTION

Numerous devices have been devised for holding various types of brushes. A patentability search located the following prior art: U.S. Pat. No. 7,234,602, issued Jun. 26, 2007, U.S. Pat. No. 3,365,761, issued Jan. 30, 1968, U.S. Pat. No. 4,884,701, issued Dec. 5, 1989, U.S. Patent App. Pub. No. US 2007/0235395, published Oct. 11, 2007, U.S. Pat. No. 1,566,860, issued Dec. 22, 1925, U.S. Pat. No. 2,121,488, issued Jun. 21, 1938, U.S. Patent App. Pub. No. US 2011/0108501, published May 12, 2011, U.S. Pat. No. 4,305,511, issued Dec. 15, 1981 and U.S. Design Pat. No. D354,989, issued Jan. 31, 1995.

The apparatus of this invention differs in a number of respects from the arrangements of the known prior art. The present invention is characterized by its ease of use, effectiveness, and relative simplicity and compactness. By making a simple rearrangement of the components thereof, the apparatus can be used to position the brushes for ease of selection and use or position the brushes for drying.

DISCLOSURE OF INVENTION

The apparatus of this invention is for holding and drying brushes having a handle and an applicator portion connected to the handle.

The apparatus includes a first brush holder component including a base and an elongated member extending from the base. The elongated member defines an interior for receiving handles of brushes to hold the brushes on end with the applicator portions thereof above the handles thereof and spaced from the base.

The apparatus also includes a second brush holder component, the second brush holder component selectively alternatively movable between the first position wherein the second brush holder component is disposed under and connected to the base of the first brush holder component and a second position wherein the second brush holder component is connected to the elongated member, supported thereby, and spaced upwardly from the base. The second brush holder component includes brush retainer structure for receiving the handles of brushes and releasably retaining the brushes with the applicator portions thereof below the handles thereof.

The second brush holder component includes an outer peripheral wall. The brush retainer structure is attached to the outer peripheral wall and includes a plurality of spaced receptacles within the confines of the outer peripheral wall. The spaced receptacles contain retainer members formed of resilient material and defining openings receiving handles of brushes and releasably retaining the brushes with the applicator portions thereof below the handles when the second brush holder component is in the second position.

Other features, advantages and objects of the present invention will become apparent with reference to the following description and accompanying drawings.

BEST MODE FOR CARRYING OUT THE INVENTION

Figure 1:
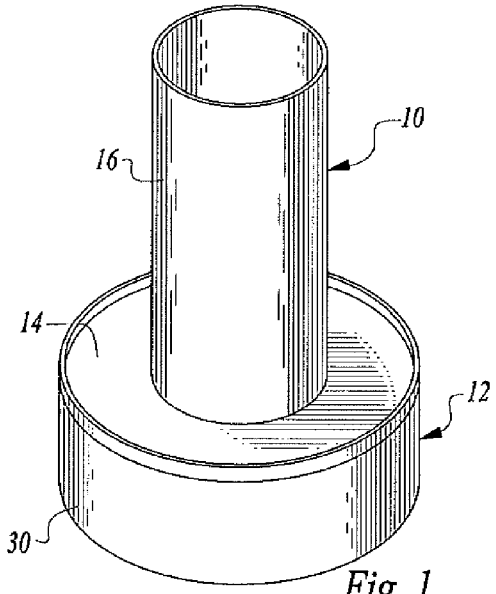
FIG. 1 is a perspective view of apparatus constructed in accordance with the teachings of the present invention.

Referring now to the drawings, apparatus for holding and drying brushes constructed in accordance with the teachings of the present invention is illustrated. The apparatus is for holding and drying brushes having a handle and an applicator portion connected to the handle.

The apparatus includes a first brush holder component 10 and a second brush holder component 12.

First brush holder component 10 includes a base 14 and an elongated member 16 extending from the base. In the arrangement illustrated, the base 14 has a circular configuration and the elongated member 16 is in the form of an open ended cylinder. The principles of the present invention can be applied utilizing different configurations.

Figure 6:
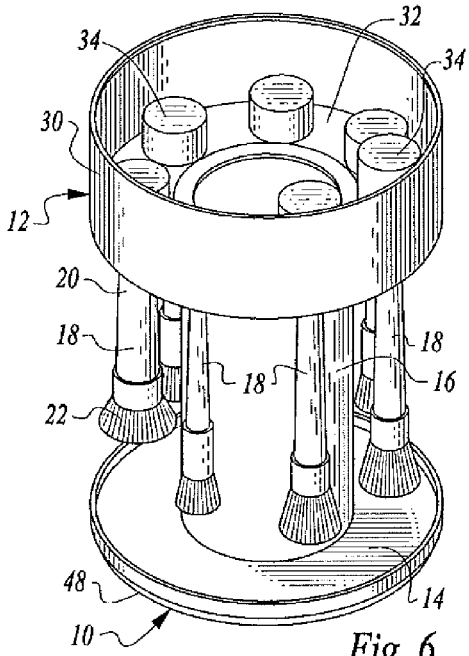
FIG. 6 illustrates the second brush holder component positioned on and supported by the first brush holder component with the brushes held by the second brush holder component extending downwardly whereby the applicator portions thereof are below the handles thereof.
Figure 7:
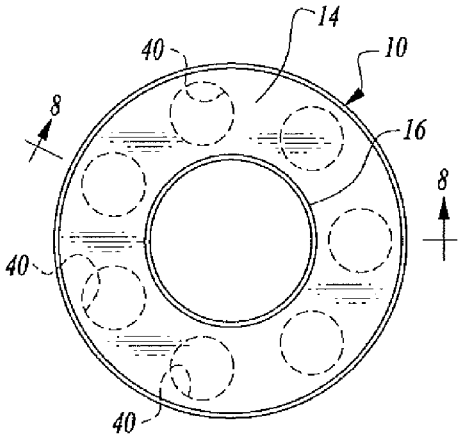
FIG. 7 is a top, plan view of the apparatus in the condition shown in FIG. 1 and without brushes held thereby.

The second brush holder component is selectively alternatively movable between a first position wherein the second brush holder component is disposed under and connected to the base 14 of the first brush holder component and a second position wherein the second brush holder component is connected to the elongated member 16 and spaced upwardly from the base. The second brush holder component first position is shown in FIGS. 1, 2, 7 and 8. The second brush holder component second position is illustrated in FIG. 6.

Figure 2:
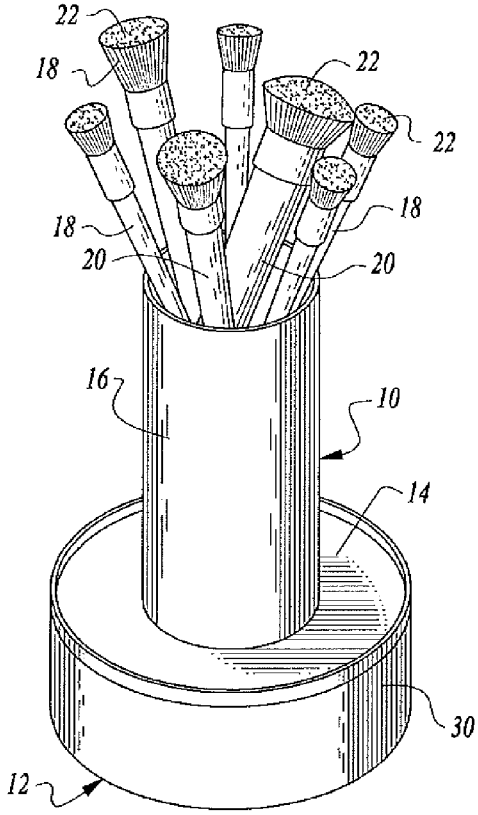
FIG. 2 is a view similar to FIG. 1, but illustrating a plurality of cosmedic brushes held thereby with the applicator portions thereof (for example bristles) above the handles, the brushes being presented for selected use.
Figure 8:
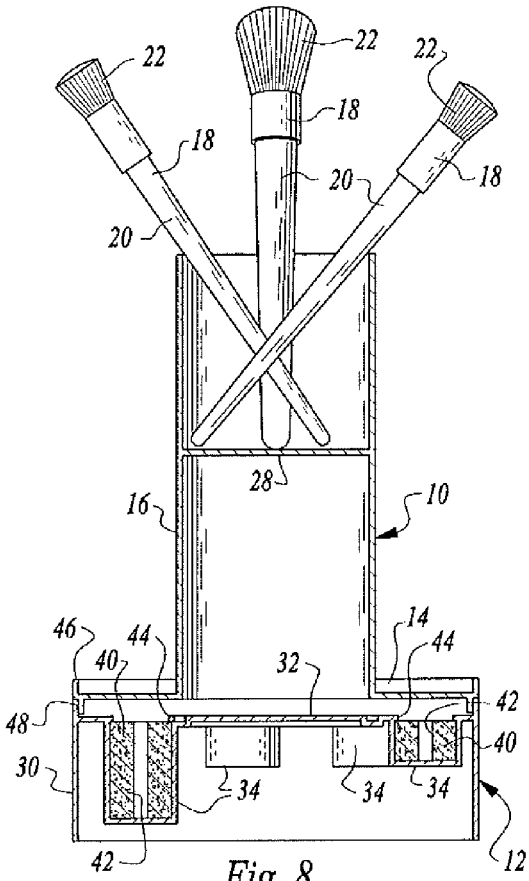
FIG. 8 is an enlarged, cross-sectional view taken along line 8-8 of FIG. 7 and illustrating three brushes held by the elongated member of the first brush holder component.

FIGS. 2 and 8 illustrate brushes 18 being held by the apparatus when the second brush holder component is in the second position. The brushes 18 illustrated may typically be, for example, cosmetic brushes and, as is conventional, each brush has a handle 20 and an applicator portion 22 connected to the handle. The applicator portion may, for example, comprise bristles.

As illustrated in FIG. 8, a partition 28 is located within the interior of the elongated member 16. This partition is engaged by the brush handles and supports the brushes to hold the brushes on end with the applicator portions thereof above the handles thereof and spaced from the base 14. The brushes are thus exposed for ready identification and access by a user when desired.

The second brush holder component 12 includes a circular-shaped outer peripheral wall 30. The second brush holder component includes brush retainer structure for receiving the handles of brushes and releasably retaining the brushes with the applicator portions thereof below the handles thereof when the second brush holder component is in the second position, for example to facilitate drying thereof.

More particularly, the brush retainer structure includes a support panel 32 connected to the outer peripheral wall 30. Extending from the support panel 32 at spaced locations thereon are receptacles 34 positioned within the confines of the outer peripheral wall 30. The receptacles may, if desired, have different configurations. For example, the receptacle 34 illustrated in cross-section in the left-most position in FIG. 8 is longer than other receptacles 34.

The spaced receptacles 34 contain retainer members 40 formed of resilient material such as elastomeric foam or the like, and define openings 42 which may, if desired, be of different sizes. The openings 42 receive handles 20 of brushes as shown, for example in FIG. 4, wherein brushes of different configuration and handle sizes are shown positioned in all but one of the resilient members to retain the brushes in place and wherein one brush is shown in the process of either being removed from or inserted into one of the resilient retainer members.

With further reference to FIG. 8, it is to be noted that the support panel 32 includes retainer member engagement structure partially extending over the retainer members to frictionally maintain the retainer members in place. In particular, the retainer member engagement structure comprises small tabs 44 disposed inwardly about the upper peripheries of the receptacles. It will be appreciated, however, that the retainer members, being formed of suitable material such as resilient plastic foam, may be manually distorted enough to allow ready insertion or removal, if desired.

When the second brush holder component 12 is in its first position as shown in FIGS. 1, 2, 7 and 8, the base 14 of the first brush holder component is positioned on the second base holder component. In this position the base covers the receptacles 34. Outer peripheral wall 30 of the second brush holder component has a rim portion 46 extending upwardly from the support panel 32. The base 14 of the first brush holder component 10 defines a recess 48 for receiving the rim when the second brush holder component is in its first position.

Figure 3:
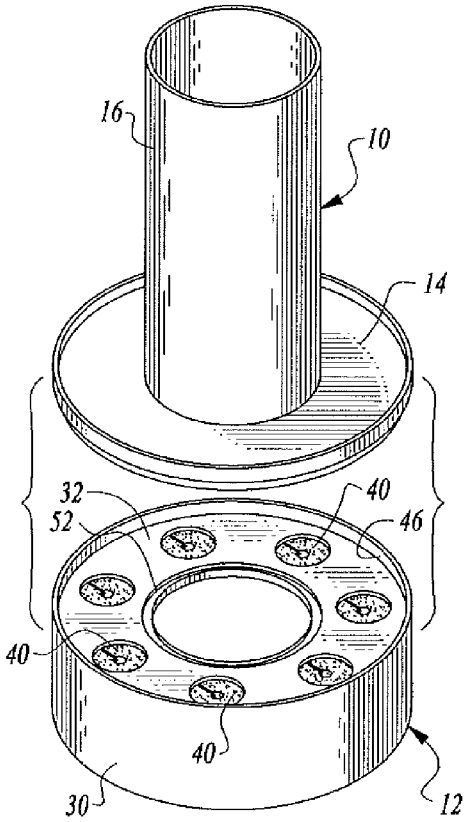
FIG. 3 is an exploded view illustrating a first brush holder component of the apparatus removed from a second brush holder component.
Figure 4:
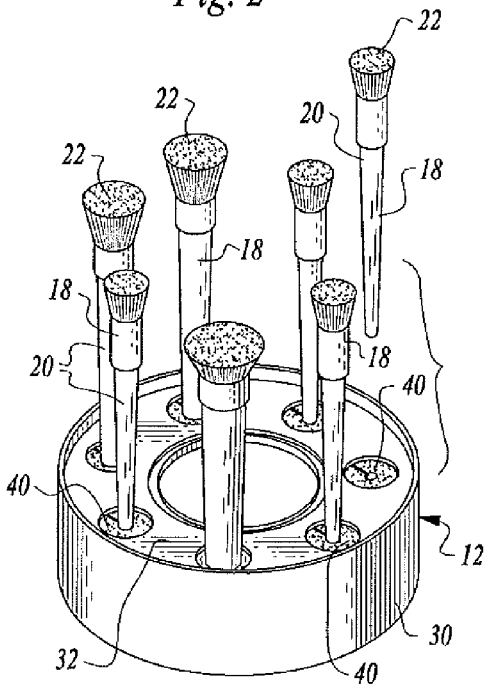
FIG. 4 illustrates several brushes held by the second brush holder component and another brush prior to insertion into position.

FIG. 3 shows the first brush holder component 10 removed from the second brush holder component 12 to expose the brush retainer structure including support panel 32 and receptacles 34. After removal of the first brush holder component 10, the brushes 18 may be inserted into the retainer members 40 as shown in FIG. 4. Usually this step takes place after the brushes have been used and cleaned, but not dried.

Figure 5:
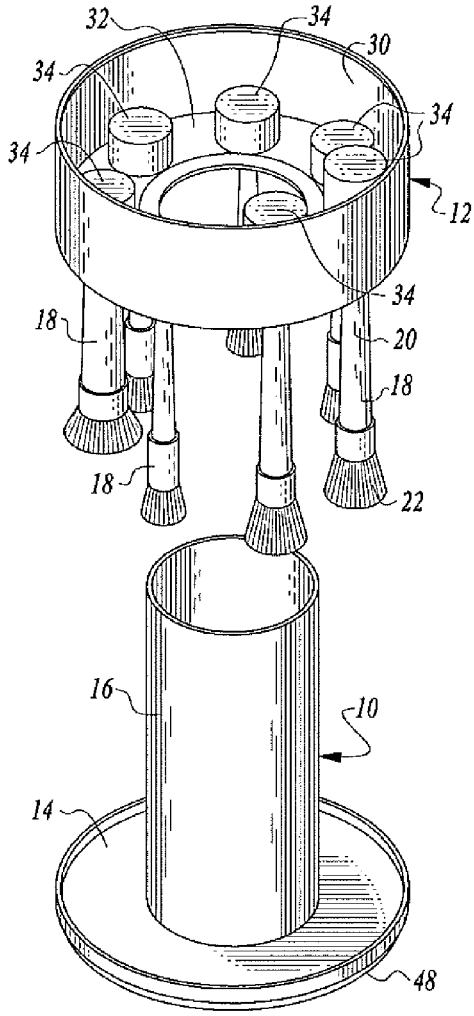
FIG. 5 is a perspective view illustrating the second brush holder component and brushes retained thereby having been inverted and prior to placement of the second brush holder component on the first brush holder component.

FIG. 5 illustrates the next procedural step carried out. After the brushes have been connected thereto, the second brush holder component 12 is inverted and placed over the first brush holder component. The brush holder components are then placed into engagement to provide the configuration shown in FIG. 6. In such configuration the apparatus promotes drying of the brushes. Separation of the brushes promotes the drying process since application portions of the brushes are completely exposed to air.

A circular recess or channel 52 is formed in the support panel 32 which matches the shape of the outer open distal end of elongated member or cylinder 16 whereby the first brush holder component and second brush holder component are stabilized against relative movement. The retainer structure of the second brush holder component releasably retains the brushes with the applicator portions thereof below the handles thereof during the drying operation.

After drying, the brushes may be readily removed from the second brush holder component and the apparatus reconfigured to its original position as shown in FIGS. 1, 2, 7 and 8 whereupon the brushes may be inserted into the elongated member 16.

The invention claimed is:

1. Apparatus for holding and drying brushes having a handle and an applicator portion connected to said handle, said apparatus comprising, in combination:

a first brush holder component including a base and an elongated member extending from said base, said elongated member defining an interior for receiving handles of brushes to hold the brushes on end with the applicator portions thereof above the handles thereof and spaced from said base; and a second brush holder component selectively alternatively movable between a first position wherein said second brush holder component is disposed under and connected to the base of said first brush holder component and a second position wherein said second brush holder component is connected to said elongated member, supported thereby, and spaced upwardly from said base, said second brush holder component including brush retainer structure for receiving the handles of brushes and releasably retaining the brushes with the applicator portions thereof below the handles thereof, said second brush holder component including an outer peripheral wall and said brush retainer structure attached to said outer peripheral wall and including a plurality of spaced receptacles within the confines of said outer peripheral wall, said spaced receptacles containing retainer members formed of resilient material and defining openings adapted to receive handles of brushes and adapted to releasably retain the brushes with the applicator portions thereof below the handles when said second brush holder component is in said second position.

2. The apparatus according to claim 1 wherein said resilient material is plastic foam.

3. The apparatus according to claim 1 wherein at least some of the receptacles differ in size whereby brushes having different sized handles may be located in said receptacles and retained in place by the retainer members.

4. The apparatus according to claim 1 wherein said brush retainer structure further includes a support panel connected to said outer peripheral wall, said receptacles extending downwardly from said support panel when said second brush holder component is in said first position and extending upwardly from said support panel when said second brush holder component is in said second position.

5. The apparatus according to claim 4 wherein said outer peripheral wall has a rim portion extending from said support panel and wherein the base of said first brush holder component defines a recess for receiving said rim when said second brush holder component is in said first position.

6. The apparatus according to claim 5 wherein the base of said first brush holder component covers said receptacles when said second brush holder component is in said first position.

7. The apparatus according to claim 4 wherein the elongated member of said first brush holder component has a distal end and wherein the support panel defines a recess receiving said distal end to stabilize said first brush holder component relative to said second brush holder component when said second brush holder component is in said second position.

8. The apparatus according to claim 4 wherein said support panel includes retainer member engagement structure partially covering at least some of said retainer members.

9. The apparatus according to claim 1 wherein said first brush holder component includes a partition within the interior of said elongated member for engagement by the handles of brushes within said interior.

* * * * *